United States Patent [19]

Norman et al.

[11] Patent Number: 4,649,941

[45] Date of Patent: Mar. 17, 1987

[54] ADJUSTABLE AIR DILUTION CIGARETTE EXHIBITING CONTROLLED PRESSURE DROP

[75] Inventors: Alan B. Norman, Clemmons; Glenn E. Creamer, Pfafftown, both of N.C.

[73] Assignee: R. J. Reynolds Tobacco Company, Winston-Salem, N.C.

[21] Appl. No.: 808,977

[22] Filed: Dec. 16, 1985

[51] Int. Cl.[4] ..... A24D 3/04; A24D 3/18

[52] U.S. Cl. ..... 131/336; 131/198.2; 131/338; 131/339; 131/341

[58] Field of Search ..... 131/198.1, 198.2, 336, 131/338–341, 361

[56] References Cited

U.S. PATENT DOCUMENTS

| | | | |
|---|---|---|---|
| 2,833,289 | 5/1958 | Atkins | 131/198.1 |
| 3,359,988 | 12/1967 | Thomson | 131/336 |
| 3,496,945 | 2/1970 | Tomkin | 131/198.1 |
| 3,503,406 | 3/1970 | Riegel et al. | 131/338 |
| 3,695,274 | 10/1972 | Summers . | |
| 3,774,622 | 11/1973 | Steigerwald . | |
| 4,273,141 | 6/1981 | Van Tilburg | 131/338 |
| 4,343,319 | 8/1982 | Cantrell . | |
| 4,380,241 | 4/1983 | Horsewell | 131/338 |
| 4,433,696 | 2/1984 | Adams | 131/336 |
| 4,526,183 | 7/1985 | Nichols et al. . | |
| 4,527,573 | 7/1985 | Hausermann . | |
| 4,532,943 | 8/1985 | Nichols et al. . | |
| 4,559,955 | 12/1985 | Brockway et al. . | |
| 4,570,649 | 2/1986 | Nichols et al. . | |
| 4,601,298 | 7/1986 | Nichols et al. . | |

FOREIGN PATENT DOCUMENTS 107507 10/1983 European Pat. Off. .

OTHER PUBLICATIONS

The Design of Cigarettes by Colin L. Browne, see pp. 50 and 51, second edition, copyright 1979, 1981 by Celanese Corp.

*Primary Examiner*—U. Millin
*Assistant Examiner*—H. Macey
*Attorney, Agent, or Firm*—Grover M. Myers

[57] ABSTRACT

A smoking article such as a filter cigarette can have an adjustable delivery air dilution while exhibiting a reduced pressure drop decrease during air dilution thereof. The pressure drop decrease is controlled during various stages of air dilution by providing a mouthpiece which exhibits greater effective length at a low or non-air dilution setting than at a high air dilution setting. Filter cigarettes of this invention are capable of exhibiting a somewhat constant smoking character at various air dilution levels.

15 Claims, 6 Drawing Figures

FIG. 2
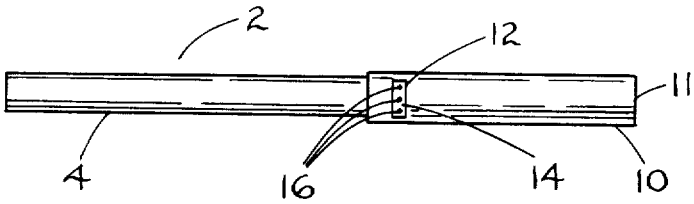
FIG. 1
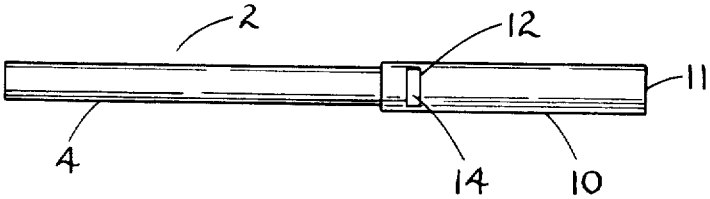
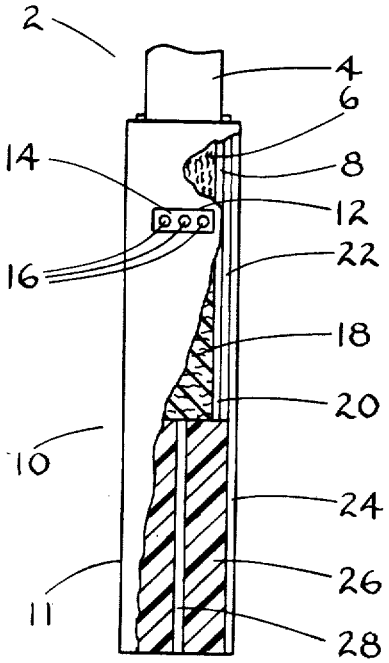
FIG. 3
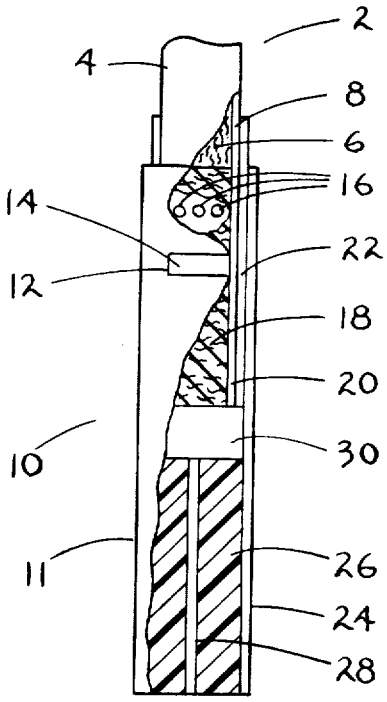
FIG. 4

ADJUSTABLE AIR DILUTION CIGARETTE EXHIBITING CONTROLLED PRESSURE DROP

BACKGROUND OF THE INVENTION

This invention relates to smoking articles, and in particular to adjustable air dilution smoking articles.

Popular smoking articles such as cigarettes comprise a substantially rod shaped structure and include a smokable material such as strands of tobacco surrounded by a wrapper such as paper. It has been desirable to provide cigarettes having filters constructed from fibrous materials such as cellulose acetate. Ventilation of the filter can be employed in order to provide an air diluted delivery.

Filtration of the smoke and ventilation of the cigarette filter can affect the flavor of the cigarette. In particular, as ventilation (or air dilution) is decreased, the flavor of the cigarette is reduced. As the air dilution of most commercial cigarettes is fixed at the factory, a smoker of a particular air diluted cigarette is forced to change brands in order to obtain a cigarette having a different air dilution but similar taste.

Recently, adjustable delivery cigarettes have become objects of interest as is evidenced by U.S. Pat. Nos. 4,433,696; 4,527,573 and 4,5216,183. The types of cigarettes as are disclosed in the aforementioned patents do not entirely provide the smoker with the most highly desirable smoking article. In particular, variable air dilution settings of such types of cigarettes provide variable pressure drops. Such variable pressure drops are highly undesirable in that a smoker is forced to change his/her smoking pattern in order to compensate for the variation in pressure drop and to resort to various ranges of effort when drawing on smoking of articles having variable air dilution settings. Thus, the smoker does not have available a variable air dilution cigarette which exhibits a substantially constant smoking character throughout the range of variable air dilution settings.

As disclosed in U.S. Pat. No. 4,532,943; an adjustable delivery cigarette can have a filter plug comprising a first mouth-end segment of filter tow axially connected to a second rod-end segment of filter tow for rotation about the axis of the cigarette. In addition, it is disclosed that passages in the first and second segments can be in varying degrees of registry upon rotation of the aforementioned segments in order to vary the resistance to draw of the cigarette. Such an adjustable delivery cigarette having a variable resistance to draw would appear to provide a change in resistance to draw only upon essentially complete misalignment of the passages. Thus, it is expected that the cigarettes would exhibit numerous air dilution settings while having essentially only two resistance to draw settings. In addition, it would appear that an adustable delivery cigarette having a variable resistance to draw is difficult to manufacture as the passages would have to be formed, misaligned (i.e., into the high resistance to draw setting) when the high air dilution opening is provided, and realigned into the low air dilution setting (and low resistance to draw setting) for packaging.

Smoking articles exhibiting controlled pressure drop are disclosed in U.S. Pat. Nos. 3,774,622; 3,695,274,; 4,343,319 and 4,380,241. However, such disclosed smoking articles are not variable air dilution smoking articles.

It would be highly desirable to provide a smoking article such as a filter cigarette, having a means to provide variable air dilution settings, and being capable of exhibiting a controlled pressure drop throughout the range of air dilution settings.

SUMMARY OF THE INVENTION

This invention is an adjustable air dilution smoking article comprising (a) a rod of smokable material;

(b) a filter means attached to one end of the rod and having an air dilution region therein; and (c) a mouthpiece element circumscribing at least a portion of the filter means, said mouthpiece element including a means for adjusting the level of airflow through the air dilution region of the filter means and a means for maintaining a substantially constant pressure drop through the smoking article at selected amounts of airflow, wherein said means for maintaining a substantially constant pressure drop includes a delivery means and a means for adjusting the effective length of the mouthpiece element.

This invention preferably is a smoking article capable of exhibiting a substantial reduction of pressure drop decrease with increased air dilution thereof. The smoking article is in the form of a filter cigarette including in combination a rod of smokable material, an axially aligned filter plug adjacent one end of the rod, a substantially air impermeable tipping material circumscribing and being fixedly attached to each of the filter plug and a portion of the rod in the region adjacent the filter plug. The smoking article further comprises a mouthpiece element including a delivery means axially aligned at one end of the filter plug and a sleeve circumscribing at least the delivery means, at least a portion of the filter plug, and optionally a portion of a region of the rod adjacent the filter plug. The delivery means is fixedly attached to the inner region of the sleeve and has a longitudinally extending path of least resistance therethrough. The mouthpiece element is movable relative to the filter plug along the longitudinal axis of the smoking article whereby one end of the delivery means can abut the end of the filter plug adjacent thereto or can be positioned in a longitudinally extending spaced apart relationship from the plug. The filter cigarette comprises air dilution means positioned in the region circumscribed by the sleeve. The sleeve comprises an air permeable region whereby adjustment of the mouthpiece element longitudinally along the smoking article can provide (i) air dilution of the smoking article when the air permeable region of the sleeve is in radial alignment with the air dilution means of the filter cigarette, and (ii) low or non air dilution of the smoking article when a substantially air impermeable region of the sleeve is in radial alignment with the air dilution means of the filter cigarette thereby providing a barrier to air dilution. The delivery means substantially abuts the end of the filter plug adjacent thereto when the smoking article is in the air dilution setting; and the delivery means is positioned in a longitudinally extending spaced apart relationship from the filter plug when the smoking article is in the low or non air dilution setting Surprisingly, the present invention provides the user of an adjustable delivery air dilution smoking article with a useful, efficient and effective method for achieving the desirable advantages of an air dilution smoking article while consuming a smoking article capable of exhibiting a somewhat constant smoking character at various air dilution levels. The user of this invention can easily position the mouthpiece element relative to the cigarette in order to expose air dilution means and hence vary the air dilution capabilities of the smoking article

BRIEF DESCRIPTION OF THE DRAWINGS

FIG. 1 is a digrammatic illustration of an embodiment of the smoking article in the form of a filter cigarette according to this invention wherein the mouthpiece element is adjusted to the low or non air dilution setting;

FIG. 2 is a diagrammatic illustration of an embodiment of the smoking article in the form of a filter cigarette according to this invention wherein the mouthpiece element is adjusted to the high air dilution setting;

FIG. 3 is an enlarged partial view of one form of a portion of the embodiment illustrated in FIG. 2 with a portion of the rod and mouthpiece element cut away for clarity;

FIG. 4 is an enlarged partial view of one form of a portion of the embodiment illustrated in FIG. 1 with a portion of the rod and mouthpiece element cut away for clarity;

DETAILED DESCRIPTION OF THE EMBODIMENTS

Figure 5:
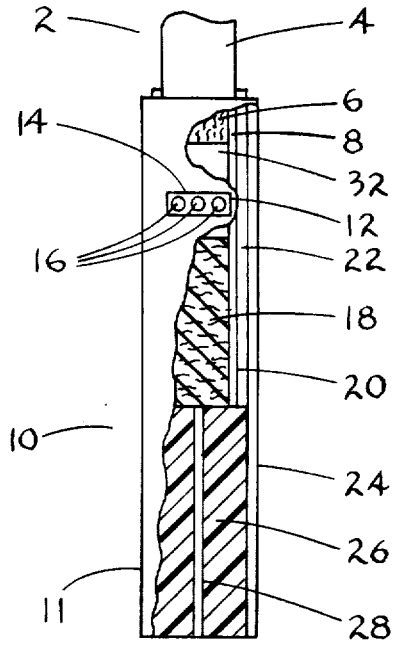
FIG. 5 is an enlarged partial view of another form of a portion of the embodiment illustrated in FIG. 2 with a portion of the rod and mouthpiece element cut away for clarity.

An embodiment of this invention shown in FIGS. 1 and 2 is a smoking article 2 in the form of a filter cigarette. The filter cigarette comprises a generally cylindrical rod 4 of smokable material contained in a wrapping material. Typically, the smokable material is a charge of tobacco, reconstituted tobacco, tobacco substitutes, and blends thereof; and the wrapping material is a conventional cigarette wrapping paper. Typically, rod 4 has a diameter comparable to conventional cigarettes and can have a diameter which ranges from about 6.4 mm to about 8 mm. Typically, rod 4 has a longitudinal length which ranges from about 57 mm to about 72 mm. The smoking article further comprises a mouthpiece region 10 comprising mouthpiece element 11 having an opening 12 therein which exposes a region of wrapping material 14 along the longitudinal surface of smoking article 2. The exposed region of wrapping material 14 is preferably a substantially air impermeable material and can be cigarette wrapping material or tipping material such as tipping paper. FIG. 1 illustrates a low or non air dilution setting of smoking article 2 whereby opening 12 in mouthpiece element 11 exposes a region of substantially air impermeable wrapping material 14. FIG. 2 illustrates a high air dilution setting of smoking article 2 whereby opening 12 in mouthpiece element 11 exposes an air permeable region such as an opening in the form of holes 16 in the wrapping material 14. The air permeable region or air dilution region can be provided by holes which extend circumferentially about the smoking article and about the longitudinal axis of the smoking article (as shown in FIG. 2), by slits, or by perforations which allow air dilution of the smoke which passes through the smoking article upon use. More than one air permeable region can be located along the longitudinal axis of the cigarette. As used herein, the term "air dilution" is the ratio of the voluem of air drawn through air dilution openings or vents to the total volume of air and smoke drawn through the smoking article and exiting the extreme mouthend portion of the smoking article. The amount of air dilution provided and the positioning of the air dilution region relative to wrapping material 14 can vary and is a matter of choice. It is most preferable to locate the air dilution region at a maximum distance longitudinally along the smoking article from the extreme mouthend point of the smoking article in order to minimize any pressure drop change upon air dilution adjustment. However, it is understood that the aforementioned maximum distance can be limited due to factors such as the length that mouthpiece element 11 extends longitudinally along the length of the smoking article. Most preferably, the air dilution region extends a minimal distance longitudinally along the smoking article. Typically, the total longitudinal length of the smoking article ranges from about 79 mm to about 140 mm in the high air dilution setting.

Referring to FIG. 3 and 4, smoking article 2 has rod 4 of smokable material 6 contained in wrapping material 8, and mouthpiece region 10. Mouthpiece region 10 includes filter plug 18 positioned adjacent to rod 4 such that filter plug 18 is axially aligned with and substantially abuts rod 4 in an end-to-end relation. Filter plug 18 has a substantially cylindrical shape and can be constructed from any conventional filter material such as air permeable cellulose acetate. The ends of filter plug 18 along the longitudinal axis of the smoking article are each open to permit the passage of air and smoke. Filter plug 18 is preferably overwrapped with circumscribing plug wrap 20 in order to form a wrapped plug. Typically, plug wrap 20 is a conventional, substantially air impermeable plug wrap material such as paper which is adhesively secured to the filter plug. Typically, filter plug 18 has a longitudinal length which ranges from about 10 mm to about 30 mm. The wrapped plug is attached to rod 4 by tipping material 22 which circumscribes both the rod and the wrapped plug. Typically, the inner surface of tipping material 22 is adhesively secured to plug wrap 20 and wrapping material 14 of an adjacent region of rod 4. Typically, tipping material 22 is a conventional material such as tipping paper. Mouthpiece region 10 also includes mouthpiece element 11. Mouthpiece element 11 comprises a sleeve region 24 circumscribing or enveloping each of filter plug 18, adjacent region of rod 4, and delivery means 26. Sleeve region 24 can be constructed from a variety of materials including plastic material or substantially air impermeable paper such as conventional tipping paper. Delivery means 26 is fixedly attached to the inner surface of sleeve region 24 at the extreme mouthend portion of the sleeve, and includes a means for providing a path of least resistance 28 of air flow therethrough. Delivery means 26 can be constructed from materials as are used in providing sleeve region 24. Delivery means 26 including means for providing a path of least resistance 28 form a device which can impede the flow of air and smoke which passes through the smoking article. Means for providing a path of least resistance 28 can be an air and smoke passage region such as a longitudinally extending hole through a solid cylinder of essentially air impermeable plastic material (shown in FIGS. 3 and 4). The longitudinally extending hole can extend through the delivery means in a linear fashion, as a spiral, or any suitable configuration which provides a determined pressure drop. In the embodiment illustrated, the diameter and length of the air passage region is such that a desirable pressure drop is maintained. Generally, the air passage has a circular cross section and the diameter is sufficiently great so as to not substantially reduce or hinder the amount of smoke reaching the user or to excessively increase the pressure drop of the smoking article. Typical diameters of the air passage range from about 0.25 mm to about 3 mm for a filter cigarette. More than one longitudinally extending tubular hole can be used. Alternatively delivery means 26 can be constructed from a closed cell foam plastic material having a path of least air resistance therethrough; from a material which forms a series of baffles; or from treated cellulose acetate filter tow whereby there is provided varying degrees of density or other means for providing ranges of air impermeability to the tow. Delivery means 26 has a substantially cylindrical shape and is axially aligned with filter plug 18 in an end-to-end relation. Typically, delivery means 26 has a longitudinal length which ranges from about 10 mm to about 25 mm. Opening 12 is provided in the sleeve region 24 (shown in FIGS. 3 and 4); although the opening can be an air permeable, perforated or screen-like configuration, or can be manufactured from an air permeable material. Typically, the size of opening 12 is such that the air permeable region of wrapping material 14 can be exposed at the desired air dilution adjustment (i.e., the air permeable region of the sleeve is in radial alignment with the air dilution means of the filter cigarette), while the dilution means can be covered by the substantially air impermeable sleeve 24 at the desired low or non air dilution adjustment thereby providing a barrier to air dilution (i.e., the air impermeable region of the sleeve is in radial alignment with the air dilution means of the filter cigarette). In the embodiment illustrated in FIGS. 3 and 4, wrapping material 14 is tipping material and underlying plug wrap.

FIG. 3 illustrates smoking article 2 in the high air dilution setting whereby mouthpiece element 11 is adjusted such that one end of delivery means 26 substantially abuts the adjacent end of filter plug 18. Opening 12 in mouthpiece element 11 exposes holes 16 in wrapping material 14 thereby providing a means for providing effective air dilution of the smoking article. The air dilution region can be located in the wrapping material which overlies filter plug 18 in a region adjacent rod 4 (as shown in FIG. 3), in the wrapping material which overlies the region where filter plug 18 abuts rod 4, or in wrapping material which overlies rod 4 in a region adjacent filter plug 18.

FIG. 4 illustrates smoking article 2 in the low or non air dilution setting whereby mouthpiece element 11 is adjusted such that a substantially air impermeable portion of sleeve region 24 overlies the air permeable region thereby covering holes 16, and thereby providing a means for substantially eliminating effective air dilution of the smoking article. Upon adjustment of the mouthpiece element, delivery means 26 is moved longitudinally away from filter plug 18 in order to provide air space 30 in a region adjacent one end of filter plug 18 and the adjacent, inner end of delivery means 26. The frictional contact between the outer surface tipping material 22 and the inner surface of sleeve region 24 is sufficient to hold the assembly in place after adjustment of the mouthpiece element.

Figure 6:
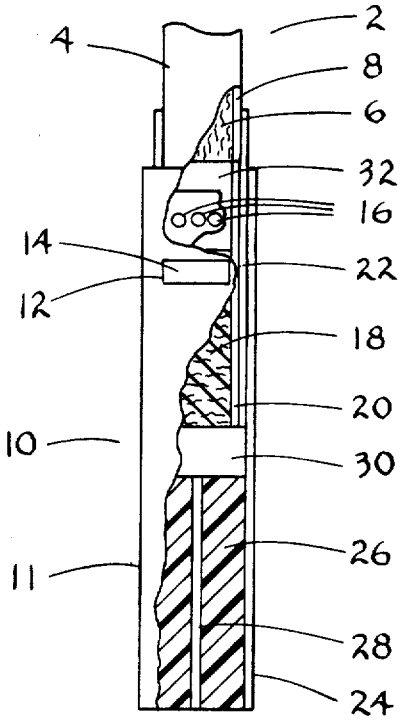
FIG. 6 is an enlarged partial view of another form of a portion of the embodiment illustrated in FIG. 1 with a portion of the rod and mouthpiece cut away for clarity.

In FIGS. 5 and 6, smoking article 2 has rod 4 of smokable material 6 contained in wrapping material 8, and mouthpiece region 10. Mouthpiece region 10 includes substantially cylindrically shaped filter plug 18 positioned adjacent to rod 4 such that filter plug 18 is axially aligned with rod 4 in an end-to-end relation. Airspace (or cavity) 32 is provided between the rod and the filter plug by the positioning of the filter plug relative to the rod. The ends of filter plug 18 are each open to permit the passage of air and smoke. Filter plug 18 is preferably overwrapped with circumscribing plug wrap 20 in order to form a wrapped plug. Typically, plug wrap 20 is a substantially air impermeable plug wrap material such as paper which is adhesively secured to the filter plug. Typically, filter plug 18 has a longitudinal length of less than about 30 mm. The wrapped plug is attached to rod 4 by tipping material 22 which circumscribes a portion of the rod airspace 32 and the wrapped plug. Typically, the inner surface of tipping material 22 is adhesively secured to plug wrap 20 and wrapping material 14 of an adjacent region of rod 4. Mouthpiece region 10 also includes mouthpiece element 11. Mouthpiece element 11 comprises a sleeve region 24 circumscribing each of filter plug 18, adjacent region of rod 4, and delivery means 26. Delivery means 26 is fixedly attached to the inner surface of sleeve region 24 at the extreme mouthend portion of the sleeve, and includes a means for providing a path of least resistance 28 of air flow therethrough. Delivery means 26 including means for providing a path of least resistance 28 form a device which can impede the flow of air and smoke which passes through the smoking article. Means for providing a path of least resistance 28 can be a hollow air and smoke passage region such as a longitudinally extending tubular hole through a solid cylinder of essentially air impermeable plastic material (shown in FIGS. 5 and 6). Opening 12 is provided in the form of a hole cut in sleeve region 24 (shown in FIGS. 5 and 6). Typically, the size of opening 12 is such that the air permeable region of wrapping material 14 can be exposed at the desired air dilution adjustment, while the dilution means can be covered by the substantially air impermeable sleeve 24 at the desired low or non air dilution adjustment thereby providing a barrier to air dilution. In the embodiment illustrated in FIGS. 5 and 6, wrapping material 14 is tipping material and underlying plug wrap.

FIG. 5 illustrates smoking article 2 in the high air dilution setting whereby mouthpiece element 11 is adjusted such that one end of delivery means 26 substantially abuts the adjacent end of filter plug 18. Opening 12 in mouthpiece element 11 exposed holes 16 in wrapping material 14 overlying airspace 32 thereby providing a means for providing effective air dilution of the smoking article.

FIG. 6 illustrates smoking article 2 in the low or non air dilution setting whereby mouthpiece element 11 is adjusted such that a substantially air impermeable portion of sleeve region 24 overlies the air permeable region thereby covering holes 16, and thereby providing a means for substantially eliminating effective air dilution of the smoking article. The adjustment of the mouthpiece element is such that delivery means 26 is moved longitudinally away from filter plug 18 in order to provide air space 30 in a region adjacent one end of filter plug 18 and the adjacent end of delivery means 26. The frictional contact between the outer surface tipping material 22 and the inner surface of sleeve region 24 is sufficient to hold the assembly in place after adjustment of the mouthpiece element.

As used herein, the term "pressure drop" in referring to smoking articles is meant that difference between atmospheric pressure and that pressure at the exit (or extreme mouthend) point of the smoking article, as measured at a given flow rate through the smoking article. Typical pressure drop values for low air dilution filter cigarettes ranges from about 95 mm to about 130 mm of water pressure drop at 17.5 ml./sec. of air flow rate. In addition, by the term "substantially reducing the pressure drop decrease" is meant a substantial reduction in the pressure drop decrease which is exhibited during air dilution. In particular, the reduction in pressure drop decrease can be such that the pressure drop of the smoking article at high air dilution nearly approximates that pressure drop at low air dilution, or that the pressure drop of the smoking article at high air dilution exceeds that pressure drop at low air dilution The smoking article in the low or non air dilution setting comprises a mouthpiece element which exhibits a greater (i.e., longer) effective length than exhibited by the mouthpiece element when the smoking article is in the high air dilution setting and thereby provides an affect to the value of the pressure drop of the smoking article. By the term "effective length" is meant that distance measured longitudinally along the smoking article from the end of the rod of smokable material to the extreme mouthend point of the smoking article. Thus, for the embodiment wherein one end of the filter plug abuts one end of the rod, and the smoking article is set at the low or non air dilution setting, the mouthpiece element exhibits an effective length which can be described as the sum of the longitudinal length of the filter plug, the air space between the filter plug and the delivery means, and the delivery means. Such an effective length is greater than the effective length of the mouthpiece when the smoking article is in the high air dilution setting wherein the air space between the filter plug and the delivery means is either relatively short in longitudinal length or essentially nonexistent. The difference in effective length of the mouthpiece element between the high air dilution setting and the low or non air dilution setting can vary and depends upon a variety of factors including the amount of air dilution, the longitudinal length of the delivery region, the properties of the path of least resistance, and the like. Typically, for a conventionally manufactured filter cigarette having a length of about 85 mm (which includes a tobacco rod having a length of about 67 mm and a filter element having a length of about 18 mm), 48 percent air dilution capability, an air impermeable delivery means having a length of about 20 mm and having extending therethrough a longitudinally extending hole or passageway, preferably having a diameter of from about 0.25 mm to about 3 mm; a difference in effective length of the mouthpiece element between the high air dilution setting and the low or non air dilution setting of from about 2 mm can be suitably employed.

It is understood that the particular embodiments described above are only illustrative of the principles of this invention, and that various modifications can be made by those skilled in the art without departing from the scope and spirit of the invention. For example, smoking articles of this invention can have a generally cylindrical cross section or an ovoidal cross section.

The following examples are provided in order to further illustrate the invention but are not to be construed as limiting the scope thereof.

EXAMPLE 1

Commercially available filter cigarettes were provided each having a cylindrical rod shape, a length of 98 mm. and a diameter of 7.18 mm. The length of the tobacco rod was 67 mm. and the length of the filter was 31 mm.; however, 13 mm of the length of the filter portion was removed from the mouth end portion of the cigarette. The cigarettes were fitted with a mouthpiece element in order to provide sample Nos. 1 and 2. Samples Nos. 3 and C-1 were provided by removing 13 mm of the length of the filter portion from the mouthend portion of the cigarette. The filter tow (as a plug) was removed from the tipping paper of the remaining cigarette and 8 mm of the length of the tow was removed in order to provide a filter element having a length of about 10 mm. The 10 mm filter tow was inserted into the tipping paper in order to provide a 8 mm air space or cavity between the end of the tobacco rod and the tobacco rod end portion of the filter element. Air dilution means was provided by using from 1 to 8 holes of about 0.25 mm diameter into the tipping paper in the region surrounding the air space or cavity. Samples Nos. 1, 2 and 3 were fitted with a mouthpiece element.

The mouthpiece element was provided by drilling a 1 mm. diameter axial hole directly through the center (i.e., along the longitudinal axis) of a solid plastic cylinder having a 20 mm. length and 8 mm. diameter and sold commercially as Delrin The cylinder so provided was attached using adhesive tape to a 20 mm. portion of a plastic drinking straw (inside diameter of the straw was 7.2 mm.) such that a sleeve and delivery portion of the mouthpiece element were provided The mouthpiece element had a cylindrical shape and a total length of 40 mm. and a diameter 7.2 mm. Two openings having 5 mm. width and 3 mm. length were cut into opposing sides of the sleeve about 3 mm. from the rod end (i.e., non mouthend) portion of the sleeve The mouthpiece element was placed on the filter end of the previously described cigarette such that the mouth end portion of the filter snugly abutted the front portion, (i.e., non mouthend portion) of the delivery portion of the mouthpiece assembly.

The resulting smoking articles (Sample Nos. 1 and 2) were provided with air dilution means by providing from 1 to 8 holes of 0.25 mm. diameter about 0.5 mm. deep into the filter through each opening in the sleeve of the flow impedance device in order to provide the desired air dilution.

The resulting smoking articles were tested for pressure drop and air dilution at various settings whereby there was high air dilution, and low air dilution. Data concerning the cigarette, pressure drop of the cigarette at various settings and air dilution are presented in Table I.

TABLE 1

| | High Air Dilution | | Low Air Dilution | | |
|---|---|---|---|---|---|
| Sample | Pres. Drop[1] | Dilution[2] | Pres. Drop[1] | Dilution[2] | Cavity[3] (mm.) |
| 1 | 151 | 42 | 141 | 27 | ~5 |
| 2 | 188 | 46 | 181 | 13 | ~5 |
| 3 | 219 | 75 | 165 | 34 | ~5 |

TABLE 1-continued

| Sample | High Air Dilution Pres. Drop[1] | High Air Dilution Dilution[2] | Low Air Dilution Pres. Drop[1] | Low Air Dilution Dilution[2] | Cavity[3] (mm.) |
|---|---|---|---|---|---|
| C-1* | 91 | 75 | 136 | 24 | — |

*Not an example of the invention. Sample C-1 was a conventional cigarette not having a mouthpiece element of this invention.

[1]Pressure drop reported in mm. $H_2O$ at 17.5 ml./sec. air flow rate.

[2]Dilution is the ratio of the volume of air drawn through air dilution openings to the total volume of air and smoke drawn through the smoking article and exiting the extreme mouthend portion of the smoking article and expressed as a percentage.

[3]Cavity is the length of the air space along the length of the smoking article which was provided at the low air dilution setting. Cavity was essentially 0 mm at high air dilution setting.

The data in Table I indicate that the samples of this invention can provide a wide range of air dilution while surprisingly exhibiting no significant decrease in pressure drop at the high air dilution setting. In addition, the data illustrate that the delivery means provides a surprisingly great increase in pressure drop upon contact with the filter element.

What is claimed is:

1. An adjustable air dilution smoking article comprising (a) a rod of smokable material;

(b) a filter means attached to one end of the rod and having an air dilution region therein; and (c) a mouthpiece element circumscribing at least a portion of the filter means, said mouthpiece element including a means for adjusting the level of airflow through the air dilution region of the filter means and a means for maintaining a substantially constant pressure drop through the smoking article at selected amounts of airflow, wherein said means for maintaining a substantially constant pressure drop includes a delivery means and a means for adjusting the effective length of the mouthpiece element.

2. The smoking article of claim 1 wherein said smoking article has a cylindrical cross section.

3. The smoking article of claim 1 wherein said air dilution means includes a region which extends circumferentially about the smoking article.

4. The smoking article of claim 1 wherein the filter means and the rod are positioned in an abutting end-to-end relationship.

5. The smoking article of claim 4 wherein the mouthpiece element further circumscribes a portion of a region of the rod adjacent the filter means.

6. The smoking article of claim 1 wherein the mouthpiece element further circumscribes a portion of a region of the rod adjacent the filter means.

7. A smoking article capable of exhibiting a substantial reduction of pressure drop decreases with increased air dilution and having the form of a filter cigarette having in combination a rod of smokable material, an axially aligned filter plug adjacent one end of the rod, a substantially air impermeable tipping material circumscribing and being fixedly attached to each of the filter plug and a portion of the rod in the region adjacent the filter plug;

said smoking article further comprising a mouthpiece element including a delivery means axially aligned at one end of the filter plug and a sleeve circumscribing at least the delivery means and at least a portion of the filter plug; the delivery means being fixedly attached to the inner region of the sleeve and having a longitudinally extending path of least air resistance therethrough;

the mouthpiece element being movable relative to the filter plug along the longitudinal axis of the smoking article whereby one end of the delivery means can abut the end of the filter plug adjacent thereto or can be positioned in a longitudinally extending spaced apart relationship from the filter plug;

the filter cigarette comprising air dilution means in the region circumscribed by the sleeve;

the sleeve comprising an air permeable region whereby adjustment of the mouthpiece element longitudinally along the smoking article can provide (i) air dilution of the smoking article when the air permeable region of the sleeve is in radial alignment with the air dilution means of the filter cigarette, and (ii) low or non air dilution of the smoking article when a substantially air impermeable region of the sleeve is in radial alignment with the air dilution means of the filter cigarette thereby providing a barrier to air dilution;

the delivery means substantially abutting the end of the filter plug adjacent thereto when the smoking article is in the air dilution setting; and the delivery means is positioned in a longitudinally extending spaced apart relationship from the filter plug when the smoking article is in the low or non air dilution setting.

8. The smoking article of claim 7 wherein said air dilution means includes a region which extends circumferentially about the smoking article.

9. The smoking article of claim 8 wherein said air dilution region comprises a series of holes.

10. The smoking article of claim 7 wherein the axially aligned filter plug adjacent one end of the rod is positioned in a substantially abutting end-to-end relationship with the rod.

11. The smoking article of claim 7 wherein the axially aligned filter plug adjacent onoe end of the rod is positioned in an end-to-end relationship with the rod, said smoking article having an air space between said plug and said rod.

12. The smoking article of claiom 7 wherein said sleeve further circumscribes a portion of a region of the rod adjacent the filter plug.

13. An adjustable air dilution smoking article comprising (a) a rod of smokable material;

(b) a filter means axially aligned with one end of the rod thereby providing an airspace therebetween, said filter means being attached to the rod by a circumscribing, substantially air impermeable wrapping material;

(c) an air dilution region in the wrapping material in the region overlying the airspace; and (d) a mouthpiece element circumscribing at least a portion of the filter means and the airspace, said mouthpiece element including a means for adjusting the level of airflow through the air dilution region and a means for maintaining a substantially constant pressure drop through the smoking article at selected amounts of airflow, wherein said means for maintaining a substantially constant pressure drop includes a delivery means and a means for adjusting the effective length of the mouthpiece element.

14. The smoking article of claim 13 wherein said smoking article has a cylindrical cross section.

15. The smoking article of claim 13 wherein said air dilution means includes a region which extends circumferentially about the smoking article.

* * * * *

UNITED STATES PATENT AND TRADEMARK OFFICE

CERTIFICATE OF CORRECTION

PATENT NO. : 4,649,941

DATED : March 17, 1987

INVENTOR(S) : Norman et al

It is certified that error appears in the above-identified patent and that said Letters Patent are hereby corrected as shown below:

In the Specification:

Column 1, line 18, after "(or air dilution)" please insert --is increased and the smoke to ventilation air ratio--.

Column 1, line 26, "4,5216,183" should be --4,526,183--.

Column 1, line 54, "cigarettes" should be --cigarette--.

Column 2, line 63, after "setting" insert --.--.

Column 4, line 3, "voluem" should be --volume--.

Column 7, line 20, after "dilution" insert --.--.

In the Claims:

Column 10, line 37, Claim 11, "onoe" should be --one--.

Column 10, line 41, Claim 12, "claiom" should be --claim--.

Signed and Sealed this

Twenty-first Day of June, 1988

*Attest:*

DONALD J. QUIGG

*Attesting Officer*

*Commissioner of Patents and Trademarks*